United States Patent [19]

Muellejans

[11] 4,360,058

[45] Nov. 23, 1982

[54] PROCESS FOR THE PREPARATION OF A SURFACE OF A METAL WALL FOR THE TRANSFER OF HEAT

[75] Inventor: Herbert Muellejans, Stuttgart, Fed. Rep. of Germany

[73] Assignee: Sueddeutsche Kuehlerfabrik julius fr. behr GmbH & Co. KG, Stuttgart, Fed. Rep. of Germany

[21] Appl. No.: 148,736

[22] Filed: May 12, 1980

[30] Foreign Application Priority Data

May 12, 1979 [DE] Fed. Rep. of Germany ..... 2919188

[51] Int. Cl.[3] ..... F28D 15/00

[52] U.S. Cl. ..... 165/104.21; 165/133; 29/157.3 H

[58] Field of Search ..... 165/105, 133, 104.21

[56] References Cited

U.S. PATENT DOCUMENTS 2,876,631 3/1959 Bailey ..... 165/133 X 3,871,407 3/1975 Bykov et al. ..... 165/133 X

FOREIGN PATENT DOCUMENTS 2706784 1/1977 Fed. Rep. of Germany .

52-40859 3/1977 Japan ..... 165/133

52-44443 4/1977 Japan ..... 165/133

1375160 11/1974 United Kingdom ..... 165/133

*Primary Examiner*—Albert W. Davis, Jr.

*Attorney, Agent, or Firm*—Schwartz, Jeffery, Schwaab, Mack, Blumenthal & Koch

[57] ABSTRACT

An improved metallic heat transfer surface for heat transfer during change of phase of a medium in contact therewith and method of making. A smooth metallic surface is lightly etched to form evaporation and/or condensation nuclei. The nuclei are defined by peaks and valleys in the material, the peaks substantially extending to the envelope of the surface prior to etching and the vallyes extending into said material not more than $10\mu(1\times10^{-3}\text{mm})$.

3 Claims, 4 Drawing Figures

PROCESS FOR THE PREPARATION OF A SURFACE OF A METAL WALL FOR THE TRANSFER OF HEAT

BACKGROUND OF THE INVENTION

The invention concerns a process for the preparation of a surface of a metal wall for the transfer of heat during the evaporation and condensation, respectively, of liquid and vapor phase media, respectively, preferably in heat-tubes. The invention equally concerns heat-tubes produced by the above-mentioned process.

It is known that roughening the surface of metal walls will improve their heat transfer properties. Thus, it has been proposed in DE-OS No. 25 46 444 to mechanically roughen a heat transfer wall for boiling liquids, to provide a plurality of so-called evaporation nuclei. Vapor bubbles will be formed on these locations when the boiling temperature is reached and thus the transfer of heat by such walls is improved. However, such a mechanical process is highly involved and expensive and in particular cannot be applied to inaccessible walls, for example, in tubes with small diameters. It is further known from DE-P No. 636 071, to etch the surface of tubes for the purpose of heat transfer in order to obtain a larger effective heat transfer surface. This measure is based on the fact that convective heat transfer is a function of the effective surface and the surface area can be increased by means of intensive and prolonged etching.

However, the increase in surface area obtained by etching in this manner does not take into account the peculiarities of heat transfer during changes in phase, i.e., during evaporation or condensation. During change of phase the formation of the so-called evaporation or condensation nuclei is of importance.

SUMMARY OF THE INVENTION

It is therefore an object of the present invention to provide an economical method for the preparation of surfaces to facilitate heat transfer during the phase change of the medium, i.e., during evaporation and/or condensation.

It is a further object of the invention to improve the heat transfer properties of the surface, particularly in the case of heat-tubes with small internal diameters.

The above and others objects are achieved by exposing the surfaces to be treated to an etching bath for a very short period of time. This produces a surface roughness, which has a roughness of not greater than $10\mu$ ($1\times10^{-3}$ mm) and substantially improves the heat transfer properties of the wall. Chemical etching produces in a random distribution a plurality of elevations and depressions of highly varied configurations, whereby the processes of evaporation and condensation are significantly advanced.

The elevations and depressions, which in a microscopic magnification present the appearance of a mountainous landscape, form the evaporation and condensation nuclei, known in themselves. Measurements performed with such light chemically etched surfaces, particularly of heat-tubes, have shown that the transfer of heat is substantially improved in comparison with mechanically roughened surfaces. The roughness of the surface required for such an improvement, which is within a range of a few $\mu$ ($1\times10^{-3}$ mm), is obtained during a short period in which the metal surface to be treated is retained in an etching bath. This in particular renders the process more economical compared with the cumbersome and expensive mechanical roughening method. Another advantage of the process according to the invention is to be found in the fact that the etching of the tubes for the purpose of roughening simultaneously effects the degreasing of the surface of the mill product. This further enhances the economy of the process. However, the particular advantage of the process according to the invention is to be found in the field of application to heat-tubes, particularly heat-tubes with small internal diameters, because here mechanical processes are fundamentally applicable. With the process of the invention, on the other hand, it is possible to roughen even the smallest internal tube diameters and thus to increase the efficiency of such tubes substantially in an economical manner.

BRIEF DESCRIPTION OF THE DRAWINGS

A more complete appreciation of the invention and the attendant advantages thereof will be more clearly understood by reference to the following drawings, wherein.

DETAILED DESCRIPTION OF PREFERRED EMBODIMENTS

Figure 1:
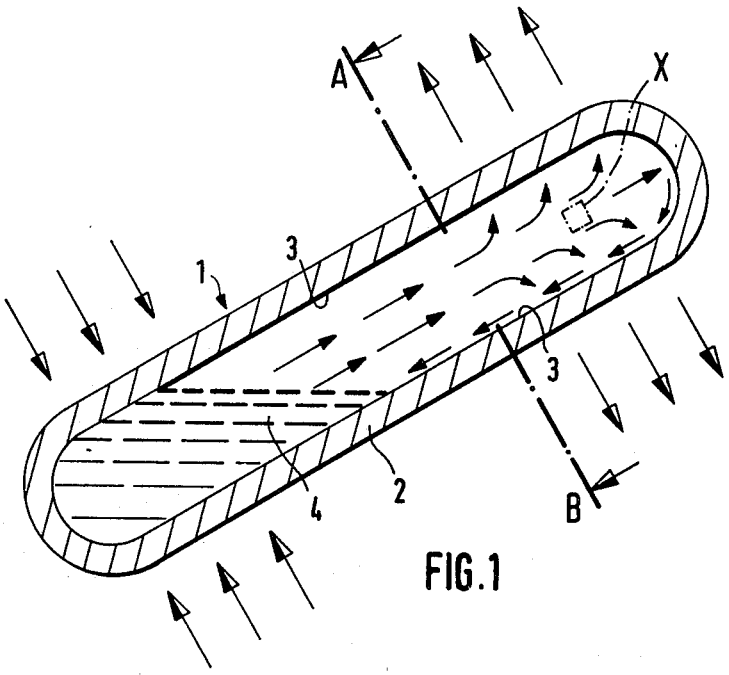
FIG. 1 shows a longitudinal section through a heat-tube.

Referring now to the drawings wherein like reference characters designate like parts throughout the several views, FIG. 1 shows a longitudinal section through the heat-tube 1, closed on all sides and partially filled with an evaporable and recondensable liquid medium 4. Heat is applied to the lower left end, i.e., the warm end, of the heat-tube 1, whereby the medium 4 is evaporated. Vapor flows inside the heat-tube 1 because of its lower specific gravity to the upper, cold end of the heat-tube, where heat is extracted, so that the vapor condenses on the cooled inner wall 2 and flows back to the lower left end, i.e., the warm end of the tube under the effect of gracity. There, the process is repeated. A portion of the figure is designated by X and represents a portion of the surface 3 according to the invention.

Figure 2:
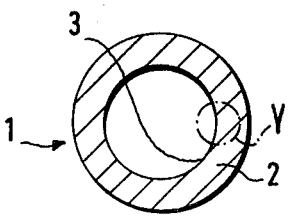
FIG. 2 is a cross-section through a heat-tube.

FIG. 2 shows a cross-section through the heat-tube 1 in the sectional plane A—B. According to this, the heat-tube 1 has an annular cross-section with a metal wall 2 forming an inner hollow cylinder, to which the medium 4 to be evaporated or condensed is applied. The entire inner wall 2 has a surface 3 roughened by light chemical etching, which is shown as the enlarged detail Y in FIG. 3.

Figure 3:
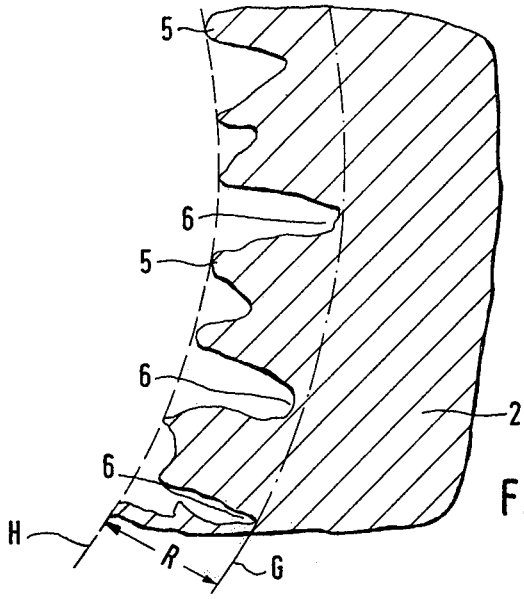
FIG. 3 shows an enlarged cross-sectional view of the heat-tube of FIG. 2.

FIG. 3 shows a highly magnified profile of the surface 3, obtained by light chemical etching. The profile of the surface 3 according to the invention is bounded on the outside by the so-called envelope profile H and on the inside by the so-called base profile H; these are shown by broken and dot-dash lines respectively. The elevations 5 and the depressions 6, distributed in irregular forms and arrangements over the entire surface 3, are found between the two profile lines H and G. The maximum depth of the depressions is the distance between the two profile lines H and G, and is designated the depth of roughness R. This depth of roughness is preferably within a range of approximately 1 to $10\mu$ ($1\times10^{-3}$ mm). This very low depth of roughness results in the fact that it is necessary to expose the surface of the acid or the etching liquid for only a short period of time to obtain the lightly etched surface according to the invention.

It may be stated in this respect that the envelope profile H corresponds to the original profile of the inner wall, i.e., in its mechanically smooth state; the surface 3 is thus being lightly etched just enough so that the peaks of the elevations 5 remain in the surface of the original profile; i.e., the envelope profile of the surface 3 etched in accordance with the invention and the envelope profile of the original, mechanically smooth surface are approximately identical. There is, therefore, no significant erosion enlargement of the surface by the chemical etching. Additionally, there is no increase in the surface in a thermal engineering sense of creating a larger available surface for the exchange of heat because the depressions 6 provided by the light chemical etching are so narrow that they are not wetted by the medium and thus are not able to form an additional heat exchange surface. Heat transfer rates of lightly etched surface according to the invention could be increased by 10 percent in comparison to smooth metal:

EXAMPLE (preferred embodyment)

Material to be etched: Cu
Etching solution:
80% $H_2O$
15% $H_2SO_4$
5% $Na_2Cr_2O_7$
Etching time: less than 1 min.

Figure 4:
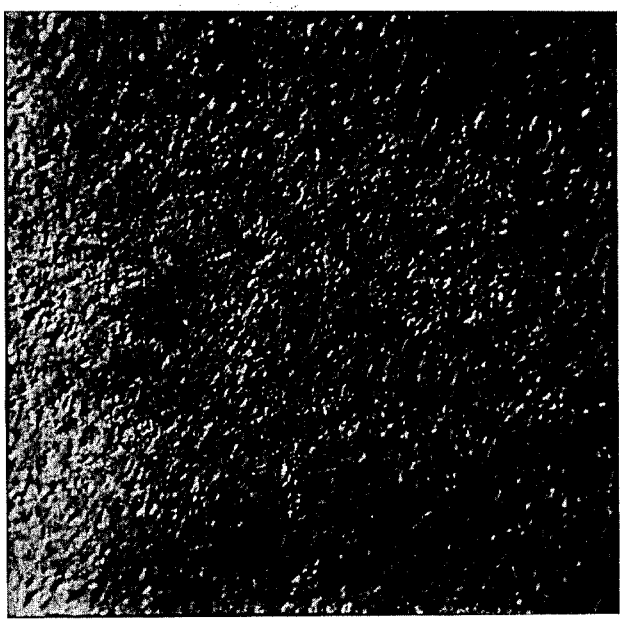
FIG. 4 is a photographic enlargement of a portion of the surface treated according to the invention.

FIG. 4 finally shows a detail X of FIG. 1, i.e., a highly magnified photograph of a portion of the surface 3 according to the invention. It may be seen in this enlargement that the surface represents a structure of random elevations and depressions, which resemble a mountainous landscape. A surface structure according to the invention of this type for heat-tubes may be obtained only by light chemical etching, i.e., the treatment of a mechanically smooth finish metal surface with an acid or a base.

Although the invention has been described relative to a specific embodiment thereof, it is not so limited and many modifications and variations thereof will be readily apparent to those skilled in the art in light of the above teachings. It is, therefore, to be understood that, within the scope of the appended claims, the invention may be practiced otherwise than as specifically described.

The embodiments of the invention in which an exclusive property or privilege is claimed are defined as follows:

1. A heat-tube having contained for flow therein a medium which transports and transfers heat and which medium is vaporizable and condensable, said heat-tube having a first portion where the medium is vaporized by the application of heat and a second portion where the medium is condensed, and said heat-tube having an inner metallic wall effective for heat transfer, produced according to the process of providing a mechanically smooth surface of said metallic wall; and chemically etching said smooth surface to an extent that valleys at least with respect to the original smooth surface, are formed therein with peaks lying on the envelope of said original smooth surface, said peak-to-valley distance not exceeding $10\mu$.

2. Heat-tube according to claim 1, wherein an external surface of said heat-tube is roughened by chemical etching and has a plurality of peaks and valleys.

3. Heat-tube according to claim 1 or 2, wherein the peak-to-valley depths R of surfaces roughened by chemical etching lie in the range of 1 to $10\mu$ ($1\times10^{-3}$ mm).

* * * * *